US010356511B2

(12) United States Patent
Mei et al.

(10) Patent No.: US 10,356,511 B2
(45) Date of Patent: Jul. 16, 2019

(54) ULTRATHIN ACOUSTIC IMPEDANCE CONVERTER

(71) Applicant: DALIAN UNIVERSITY OF TECHNOLOGY, Dalian, Liaoning Province (CN)

(72) Inventors: Yulin Mei, Dalian (CN); Xiaoming Wang, Dalian (CN); Yixuan Mei, Dalian (CN); Yuanxiu Wang, Dalian (CN)

(73) Assignee: DALIAN UNIVERSITY OF TECHNOLOGY, Liaoning (CH)

( * ) Notice: Subject to any disclaimer, the term of this patent is extended or adjusted under 35 U.S.C. 154(b) by 0 days.

(21) Appl. No.: 15/771,922

(22) PCT Filed: Jul. 18, 2016

(86) PCT No.: PCT/CN2016/090258
§ 371 (c)(1),
(2) Date: Apr. 27, 2018

(87) PCT Pub. No.: WO2017/201845
PCT Pub. Date: Nov. 30, 2017

(65) Prior Publication Data

US 2018/0310092 A1 Oct. 25, 2018

(30) Foreign Application Priority Data

May 24, 2016 (CN) ..... 2016 1 0353435

(51) Int. Cl.
*H04R 1/28* (2006.01)
*G10K 11/02* (2006.01)

(52) U.S. Cl.
CPC ..... *H04R 1/2876* (2013.01); *G10K 11/02* (2013.01); *H04R 1/2873* (2013.01)

(58) Field of Classification Search
CPC ..... H04R 1/2876; H04R 1/2869; H04R 1/02
See application file for complete search history.

(56) References Cited

U.S. PATENT DOCUMENTS 3,649,430 A * 3/1972 Lewis ..... A47B 96/205 428/138
6,628,797 B2 * 9/2003 Yamada ..... H04R 1/2888 181/153

FOREIGN PATENT DOCUMENTS

CN 1812639 A 8/2006
CN 102487475 A 6/2012
(Continued)

*Primary Examiner* — Sunita Joshi
(74) *Attorney, Agent, or Firm* — Muncy, Geissler, Olds & Lowe, P.C.

(57) ABSTRACT

The present invention discloses a ultrathin acoustic impedance converter belonging to the acoustic field, which is characterized by comprising one or a plurality of impedance conversion units, wherein each impedance conversion unit is composed of a frame, a plurality of prestressed membranes or prestressed string nets, and multiple layers of acoustic materials, wherein a through cavity is fabricated in the frame, the prestressed membranes or string nets and the acoustic materials are alternately arranged in the cavity, i.e., a prestressed membrane or string net is arranged, and then a layer of acoustic materials is arranged, and so on until the through cavity is fully filled. The cavity can be designed in different shapes either with a variable cross section or a uniform cross section. Each prestressed membrane or string net is required to be applied with prestress before being arranged in the cavity, and the magnitude of the prestress depends on the acoustic impedance value that the membrane or string net is expected to reach. The novel ultrathin acoustic impedance converter of the present invention can
(Continued)

realize rapid change from low impedance to high impedance or from high impedance to low impedance and realize ultrathin design.

4 Claims, 6 Drawing Sheets

(56) References Cited

FOREIGN PATENT DOCUMENTS

| | | | |
|---|---|---|---|
| CN | 103079156 | A | 5/2013 |
| CN | 103618979 | A | 3/2014 |
| CN | 204442681 | U | 7/2015 |
| CN | 205610901 | U | 9/2016 |
| EP | 1173040 | A2 | 1/2002 |

* cited by examiner

ULTRATHIN ACOUSTIC IMPEDANCE CONVERTER

TECHNICAL FIELD

The present invention relates to a novel ultrathin acoustic impedance converter, which belongs to the technical field of acoustics.

BACKGROUND

In recent years, the ultrathin design of various products is popular in the world, including ultrathin mobile phones, ultrathin TV sets, ultrathin computers and ultrathin lightweight vibration-reduction and noise-reduction devices for military industries and civil application. To meet this requirement, domestic and foreign scholars and engineering technical personnel have carried out a lot of work. However, one of the bottleneck problems is how to achieve the ultrathin design of acoustic impedance converters. For example, for a loudspeaker as an acoustic impedance converter, the quality of tone thereof depends on the size of the end surface aperture of the loudspeaker. For the traditional loudspeaker, the larger the end surface aperture thereof is, the larger the thickness of the loudspeaker is. At present, to achieve the ultrathin design of an acoustic impedance converter, the following several methods are often used, or the structure of acoustic impedance converter is improved so that the components and parts constituting the acoustic impedance converter are compactly arranged in a limited space, for example, patent CN201310042528.0, and the like; or a piezoelectric ceramic sheet is used as an actuating element of a vibration diaphragm, for example, patent CN201010593395.2 and the like; or a flat vibration diaphragm is used, for example, patent CN201310089954.X and the like. Wherein, the development space is extremely limited by improving the structural configuration to achieve the purpose of reducing the thickness of the acoustic impedance converter; however, although the modes of using the piezoelectric ceramic sheet and the flat vibration diaphragm can substantially reduce the thickness of the acoustic impedance converter really, because of the imitation of the material or design principle thereof, the low frequency characteristics thereof are especially inadequate. At present, under the existing technical condition, design personnel can only seek a balance between the performance and required thickness of the acoustic impedance converter.

SUMMARY

To achieve the high-quality performance and ultrathin design of acoustic impedance converters, the present invention provides a novel ultrathin acoustic impedance converter.

The present invention adopts the following technical solutions:

A novel ultrathin acoustic impedance converter includes at least one impedance conversion unit which comprises a frame and filling materials thereof;

wherein a through cavity is fabricated in the frame for placing filling materials. According to different requirements for acoustic impedance conversions, the through cavity can be designed in different shapes either with a variable cross section or with a uniform cross section.

Placed in the through cavity of the frame, the filling materials comprise prestressed membranes and acoustic materials which are alternately arranged, wherein some or all of the prestressed membranes can be replaced by prestressed string nets. Specifically speaking, the filling materials comprise: from one end of the cavity, a prestressed membrane or prestressed string net, and a layer of acoustic material; a prestressed membrane or prestressed string net, and a layer of acoustic material, . . . , and so on and so forth, until the through cavity is fully filled.

The prestressed membrane or the prestressed string net means a membrane or a string net applied with prestress, i.e., each prestressed membrane or string net is applied with prestress before being placed in the cavity, and the magnitude of the prestress depends on the acoustic impedance value that the prestressed membrane or prestressed string net is required to reach.

The frame is designed into two types of structures as required, one is a multilayer structure and another is an integrated structure, wherein the multilayer structure means that the frame is composed of multiple layer structures, one layer structure is fixedly connected with the other layer structure by adhesives, rivets, screws or grooves, to enable the edge of each prestressed membrane or prestressed string net to be sandwiched between adjacent layer structures of the frame, and the prestressed membrane or prestressed string net is positioned and tensioned by sticking, compacting, clamping or tightening; and the integrated structure means that the frame is an integral whole which cannot be split, there are grooves and holes on the side wall of the cavity for positioning and tensioning all the prestressed membranes or prestressed string nets of the filling materials.

The filling materials, including the prestressed membranes and prestressed string nets as well as the acoustic materials, are fixed in the through cavity of the frame by sticking, compacting, clamping or tightening.

Each prestressed membrane or prestressed string net can be designed into different types as required, including seven types, i.e. integrated membrane, hole membrane, string net and other four types, which are described in detail as follows:

(1) integrated membrane: an integrated smooth membrane without holes;

(2) hole membrane: a membrane with holes, and the shape of the hole is roundness, oval, polygon and bounded curve;

(3) string net: filamentous strings are pulled to form a grid pattern, and at every intersection point of the grid, strings are twined together into a knot, or are overlapped each other but are not twined into a knot;

(4) combination of integrated membrane and string net: combining the integrated membrane with the string net;

(5) combination of hole membrane and string net: combining the hole membrane with the string net;

(6) variant type based string net: filamentous strings are pulled to form a grid pattern, and at every intersection point of the grid, strings are connected together by a firm and stiff membrane;

(7) variant type based on string net: filamentous strings are pulled to form a grid pattern, and at every intersection point of the grid, strings are connected together by a polygonal net;

Each layer of multilayer acoustic materials of the filling materials is designed into different types of structures as required, including integrated structure, porous structure, solid filling structure, 3D string net structure and other four types of structures which are described in detail as follows:

(1) integrated structure: the acoustic material layer is a whole without holes;

(2) porous structure: the acoustic material layer has holes in it, and the shape of the hole is sphere, cylinder, truncated cone, cone, polyhedron or prism;

(3) solid filling structure: the acoustic material layer has solids in it, and the shape of the solid is sphere, cylinder, truncated cone, cone, polyhedron or prism;

(4) 3D string net structure: filamentous strings are pulled to form a 3D grid pattern, and at every intersection point of the grid, strings are twined together into a knot, or are overlapped each other but are not twined into a knot;

(5) combination of integrated structure and 3D string net structure: combining the integrated structure with the 3D string net structure;

(6) combination of porous structure and 3D string net structure: combining the porous structure with the 3D string net structure;

(7) variant type based on 3D string net structure: filamentous strings are pulled to form a 3D grid pattern, and at every intersection point of the grid, strings are connected together by acoustic material solids, and the shape of the acoustic material solid is sphere, cylinder, truncated cone, cone, polyhedron or prism;

(8) variant type based on 3D string net structure: filamentous strings are pulled to form a 3D grid pattern, and at every intersection point of the grid, strings are connected together by 3D nets or shells and the shape of the 3D net or shell is sphere, cylinder, truncated cone, cone, polyhedron or prism.

The prestressed membranes or prestressed string nets of the filling materials can be made from compound materials, high polymer materials, metal materials or non-metal materials; and for one prestressed membrane or prestressed string net, it can be made from one material or the composition of multiple materials; and for different prestressed membranes or prestressed string nets, their materials or structures can be identical or different.

The acoustic materials of the filling materials can be air, water, oil, gel, polyurethane, polyester, foamed plastics, foamed metal, sonar rubber, butyl rubber, glass wool, glass fiber, felt, perforated plate and the like; and for one acoustic material layer, it can be made from one material or the composition of multiple materials; and for different acoustic material layers, their materials or structures can be identical or different.

The present invention comprises one or more impedance conversion units. And in every impedance conversion unit, by alternately arranging prestressed membranes or string nets and the acoustic materials in the cavity of the frame, the acoustic impedance conversion can be rapidly realized. In this way, the thickness of the acoustic impedance converter is substantially reduced while taking account of low frequency characteristics.

The present invention can be applied to air, water and other environments requiring acoustic impedance matching. For example, for a wind instrument such as a bass horn with longer pipe body, a trombone, a saxophone, etc., its length thereof can be effectively reduced by rational design; for a loudspeaker of a product such as a cell phone, a TV set, a computer, etc., its thickness thereof can be substantially reduced while increasing the low-frequency effect thereof; for a product such as a refrigerator, an air conditioner, a machine tool, etc., an ultrathin acoustic impedance converter can be designed, to effectively achieve the purposes of vibration reduction and noise reduction.

Figure 1:
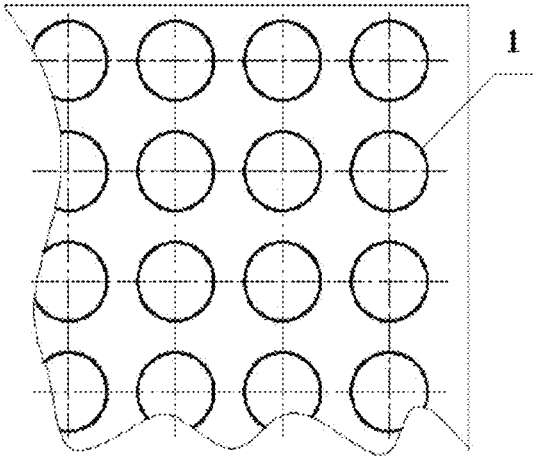
FIG. 1 is an array diagram of a novel ultrathin acoustic impedance converter comprising impedance conversion units with rounded end surfaces.

In the drawing: 1. impedance conversion unit; 2. through cavity in frame; 3. each layer of multilayer structure frame; 4. prestressed membrane or string net; 5. acoustic material layer; 6. hole in prestressed membrane or string net; 7. filamentous string composing string nets; 8. firm and stiff membrane at the intersection point of the grid; 9. polygonal net at the intersection point of the grid; 10. hole in the acoustic material layer; 11. solid in the acoustic material layer; 12. filamentous string composing 3D string net structure of the acoustic material layer; 13. acoustic material solid at the intersection point of the 3D grid; and 14. 3D net or shell at the intersection point of the 3D grid.

DETAILED DESCRIPTION

Because of different application requirements, the specific structure of "a novel ultrathin acoustic impedance converter" disclosed in the present invention will change.

The present invention is described below in detail in combination with technical solutions and drawings with respect to embodiments.

Embodiment 1

Figure 3:
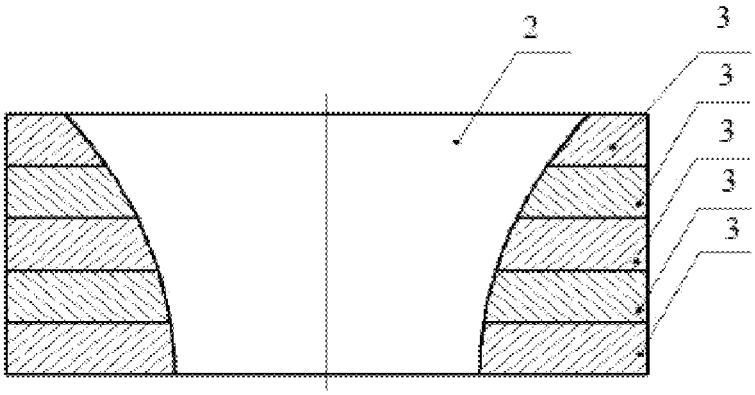
FIG. 3 shows a multilayer structure frame of an impedance conversion unit.
Figure 4:
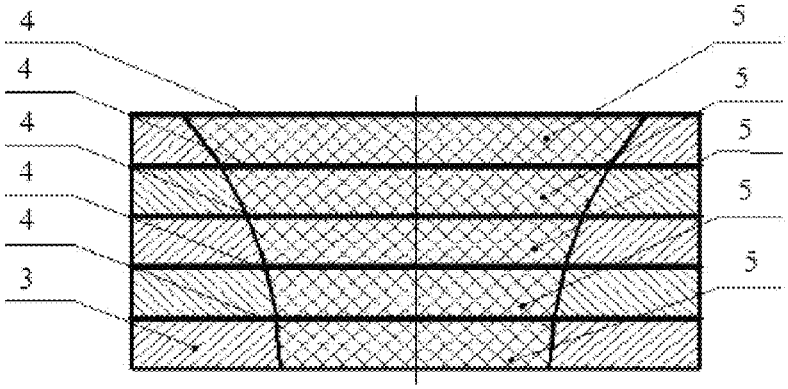
FIG. 4 shows an impedance conversion unit, wherein in the cavity, the multilayer acoustic materials are identical.
Figure 9:
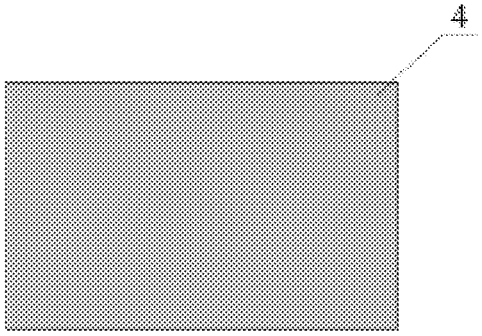
FIG. 9 is a partial enlarged diagram of a prestressed membrane, which is the integrated membrane.
Figure 16:
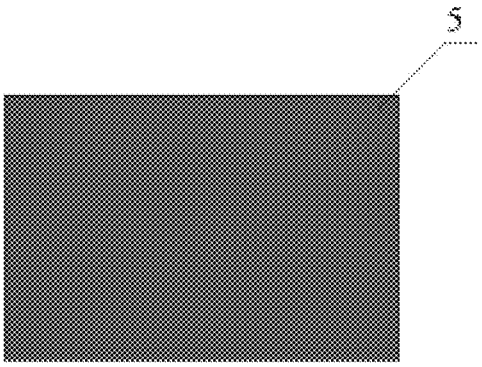
FIG. 16 is a partial enlarged diagram of an acoustic material layer, which is an integrated structure.

This embodiment only comprises one impedance conversion unit 1, as shown in FIG. 4.

Wherein the frame uses a multilayer structure, as shown in FIG. 3, one layer is fixed connected with the other layers by screws.

Wherein the through cavity in the frame is trumpet-shaped.

Wherein the prestressed membrane 4 and the acoustic material layer 5 are alternately arranged in the cavity 2, until the cavity 2 is fully filled.

Wherein all the prestressed membranes 4 in the cavity 2 use identical type and material, and all layers of acoustic materials 5 use identical structure and material.

Wherein each prestressed membrane 4 is an integrated membrane, and FIG. 9 is a partial enlarged diagram of the prestressed membrane 4.

Wherein each acoustic material layer 5 is in the shape of truncated cone with variable cross section, the side wall of the truncated cone is matched with the inner wall of the cavity 2, and FIG. 16 is a partially enlarged view of the acoustic material layer 5.

Wherein each prestressed membrane 4 is applied with prestress before being arranged in the cavity 2, and the magnitude of the prestress depends on the acoustic impedance value that the membrane is expected to reach.

Wherein the edge of the prestressed membrane 4 is sandwiched between the two adjacent layers 3 of the frame, and tensioned and positioned by sticking, clamping and compacting.

Wherein the acoustic material layers 5 are positioned by being stuck to the inner wall of the cavity 2 of the frame.

Embodiment 2

Figure 10:
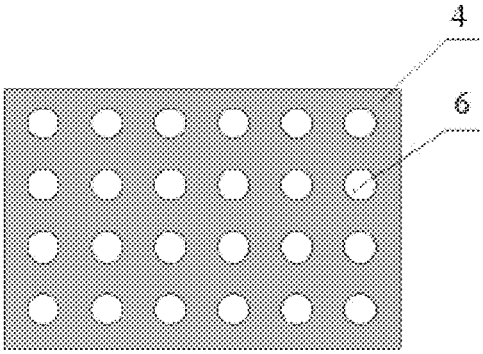
FIG. 10 is a partial enlarged diagram of a prestressed membrane, which is the hole membrane.

The embodiment and embodiment 1 are identical but only differ in that the prestressed membrane of the embodiment is a hole membrane, and FIG. 10 is a partial enlarged view of the prestressed membrane 4.

Embodiment 3

Figure 11:
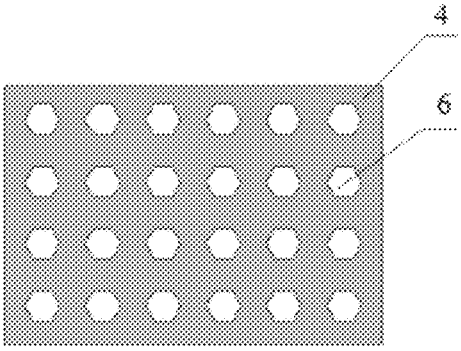
FIG. 11 is a partial enlarged diagram of a prestressed membrane, which is the hole membrane.

The embodiment and embodiment 1 are identical but only differ in that the prestressed membrane of the embodiment is a hole membrane, and FIG. 11 is a partial enlarged view of the prestressed membrane 4.

Embodiment 4

Figure 12:
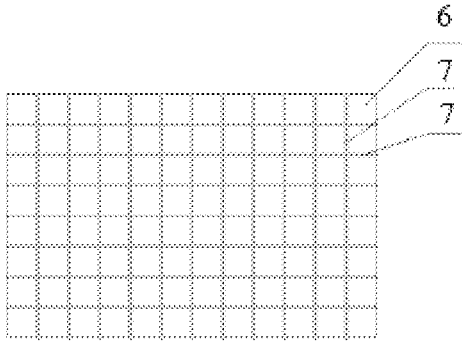
FIG. 12 is a partial enlarged diagram of a prestressed string net.

The embodiment and embodiment 1 are identical but only differ in that a prestressed string net is used in the embodiment instead of the prestressed membrane, and FIG. 12 is a partial enlarged view of the prestressed string net 4.

Embodiment 5

Figure 13:
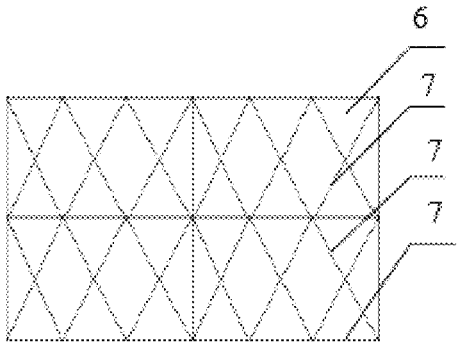
FIG. 13 is a partial enlarged diagram of a prestressed string net.

The embodiment and embodiment 1 are identical but only differ in that a prestressed string net is used in the embodiment instead of the prestressed membrane, and FIG. 13 is a partial enlarged view of the prestressed string net 4.

Embodiment 6

Figure 14:
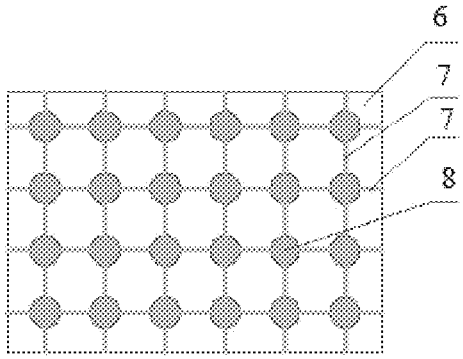
FIG. 14 is a partial enlarged diagram of a prestressed string net, which is a variant type based string net, wherein filamentous strings are pulled to form a grid pattern, and at every intersection point of the grid, strings are connected together by a firm and stiff membrane.

The embodiment and embodiment 1 are identical but only differ in that a variant type based string net is used in the embodiment instead of the prestressed membrane, and FIG. 14 is a partial enlarged view of the variant type 4.

Embodiment 7

Figure 15:
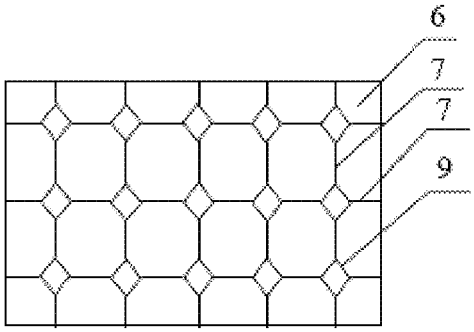
FIG. 15 is a partial enlarged diagram of a prestressed string net, which is a variant type based string net, wherein filamentous strings are pulled to form a grid pattern, and at every intersection point of the grid, strings are connected together by a polygonal net.

The embodiment and embodiment 1 are identical but only differ in that a variant type based string net is used in the embodiment instead of the prestressed membrane, and FIG. 15 is a partial enlarged view of the variant type 4.

Embodiment 8

Figure 17:
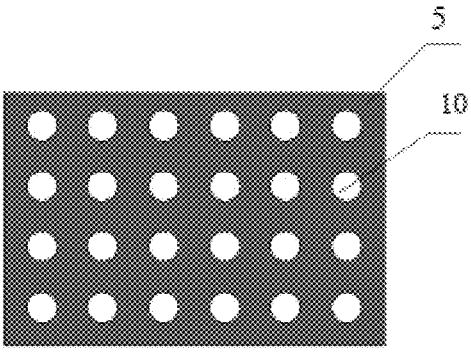
FIG. 17 is a partial enlarged diagram of an acoustic material layer, which is a porous structure.

The embodiment and embodiment 1 are identical but only differ in that the acoustic material layer 5 in the cavity 2 of the embodiment is a porous structure, and FIG. 17 is a partial enlarged view of the acoustic material layer 5.

Embodiment 9

Figure 18:
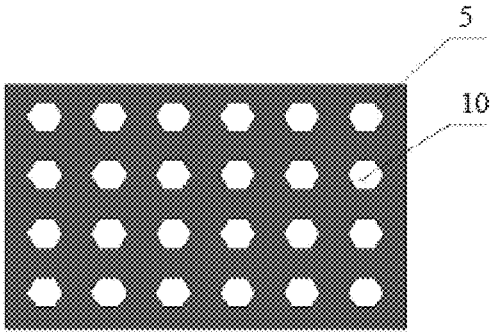
FIG. 18 is a partial enlarged diagram of an acoustic material layer, which is a porous structure.

The embodiment and embodiment 1 are identical but only differ in that the acoustic material layer 5 in the cavity 2 of the embodiment is a porous structure, and FIG. 18 is a partial enlarged view of the acoustic material layer 5.

Embodiment 10

Figure 19:
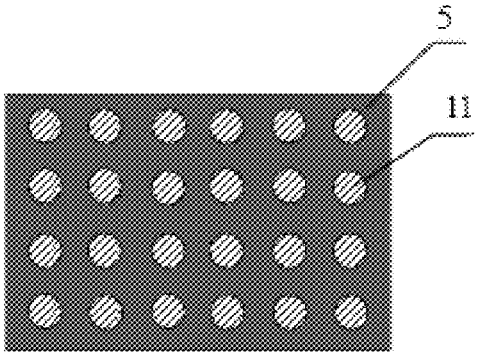
FIG. 19 is a partial enlarged diagram of an acoustic material layer, which is a solid filling structure.

The embodiment and embodiment 1 are identical but only differ in that the acoustic material layer 5 in the cavity 2 of the embodiment is a solid filling structure, and FIG. 19 is a partial enlarged view of the acoustic material layer 5.

Embodiment 11

Figure 20:
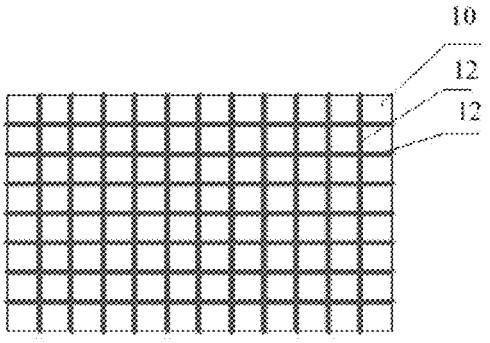
FIG. 20 is a partial enlarged diagram of an acoustic material layer, which is 3D string net structure.

The embodiment and embodiment 1 are identical but only differ in that the acoustic material layer 5 in the cavity 2 of the embodiment is a 3D string net structure, and FIG. 20 is a partial enlarged view of the acoustic material layer 5.

Embodiment 12

Figure 21:
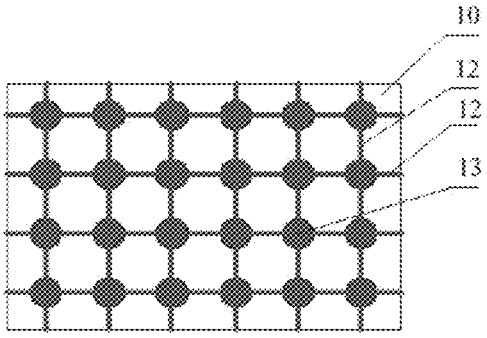
FIG. 21 is a partial enlarged diagram of an acoustic material layer, which is a variant type based on 3D string net structure, wherein filamentous strings are pulled to form a 3D grid pattern, and at every intersection point of the grid, strings are connected together by acoustic material solids, and the shape of the acoustic material solid is cylinder.

The embodiment and embodiment 1 are identical but only differ in that the acoustic material layer 5 in the cavity 2 of the embodiment is a variant type based on 3D string net structure, and FIG. 21 is a partial enlarged view of the acoustic material layer 5.

Embodiment 13

Figure 22:
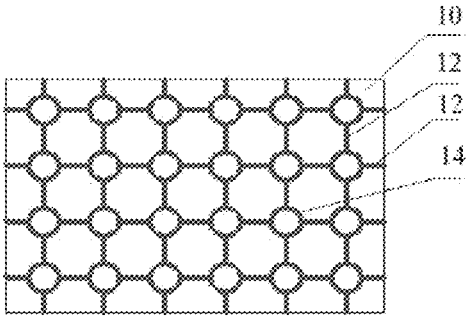
FIG. 22 is a partial enlarged diagram of an acoustic material layer, which is a variant type based on 3D string net structure, and at every intersection point of the grid, strings are connected together by 3D shells.

The embodiment and embodiment 1 are identical but only differ in that the acoustic material layer 5 in the cavity 2 of the embodiment is a variant type based on 3D string net structure, and FIG. 22 is a partial enlarged view of the acoustic material layer 5.

Embodiment 14

Figure 5:
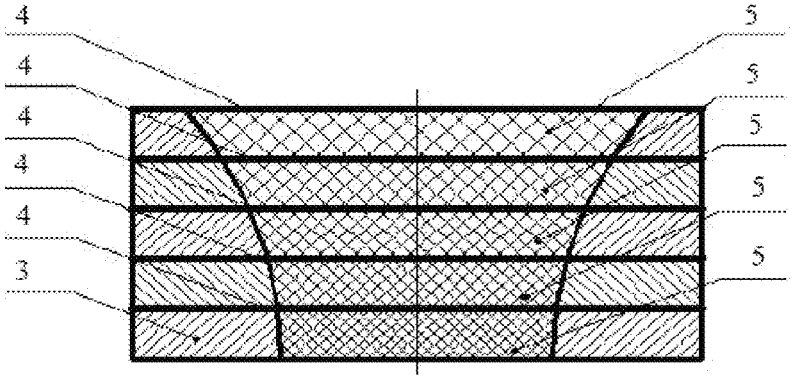
FIG. 5 shows an impedance conversion unit, wherein in the cavity, the multilayer acoustic materials are different.

The embodiment and embodiment 1 are identical but only differ in that the multilayer acoustic materials 5 of the embodiment use different materials, and the impedance conversion unit 1 is shown in FIG. 5.

Embodiment 15

Figure 6:
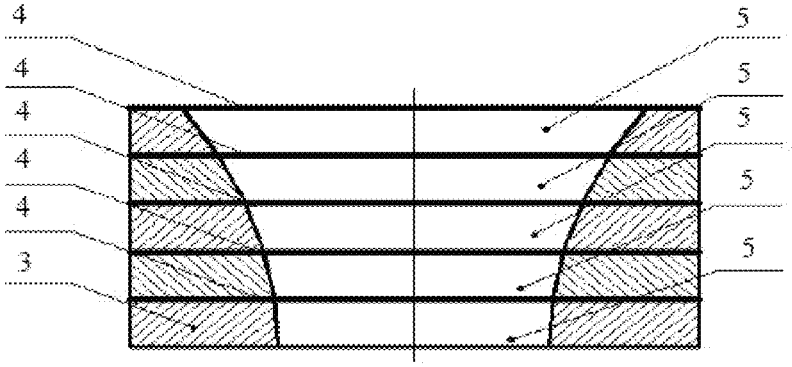
FIG. 6 shows an impedance conversion unit, wherein in the cavity, the multilayer acoustic materials are air.

The embodiment and embodiment 1 are identical but only differ in that the acoustic material 5 in the cavity 2 of the embodiment is air, and the impedance conversion unit 1 is shown in FIG. 6.

Embodiment 16

The embodiment and embodiment 1 are identical but only differ in that the frame of the embodiment is an integrated structure rather than a multilayer structure and the side wall of the cavity 2 of the frame is provided with grooves and holes for positioning and tensioning prestressed membranes 4 in the cavity 2.

Embodiment 17

Figure 7:
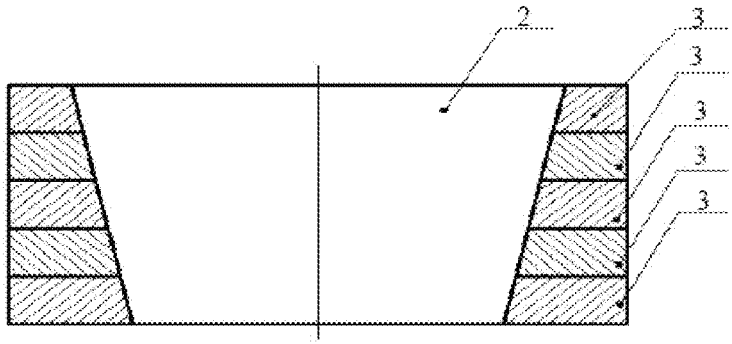
FIG. 7 shows a multilayer structure frame of an impedance conversion unit.

The embodiment and embodiment 1 are identical but only differ in the structure of the multilayer frame which is shown in FIG. 7.

Embodiment 18

Figure 8:
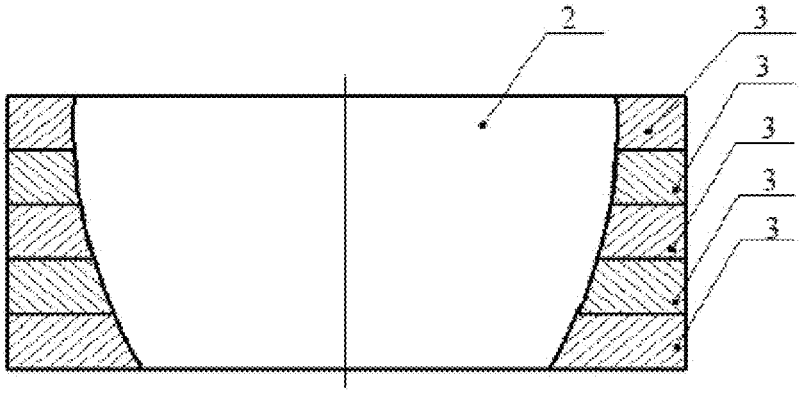
FIG. 8 shows a multilayer structure frame of an impedance conversion unit.

The embodiment and embodiment 1 are identical but only differ in the structure of the multilayer frame which is shown in FIG. 8.

Embodiment 19

Figure 2:
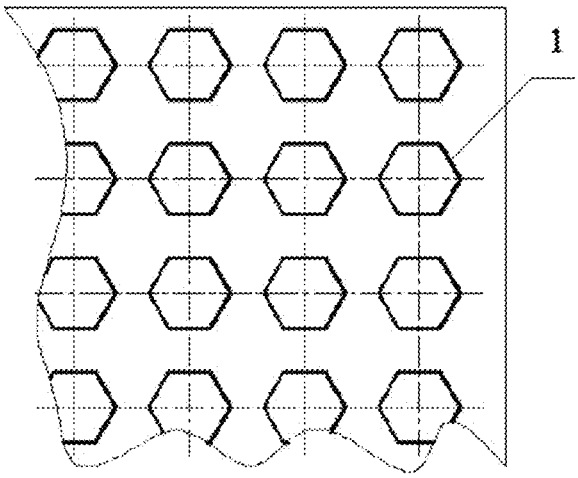
FIG. 2 is an array diagram of a novel ultrathin acoustic impedance converter comprising impedance conversion units with orthohexagonal end surfaces.

The embodiment comprises a plurality of impedance conversion units, as shown in FIG. 2, wherein all the impedance conversion units are identical and have the structure identical to embodiment 1, but the only difference from embodiment 1 is that the cross sections of the frame 3, the cavity 2 and acoustic material layers 5 are all hexagonal.

We claim:

1. A novel ultrathin acoustic impedance converter, comprising at least one impedance conversion unit which comprises a frame and filling materials thereof;

wherein a through cavity is fabricated in the frame for placing the filling materials;

the filling materials comprise prestressed membranes and multilayer acoustic materials, the prestressed membrane and the acoustic material layer are alternately arranged, and some or all of the prestressed membranes can be replaced by prestressed string nets;

the prestressed membranes or the prestressed string nets mean membranes or string nets applied with prestress, i.e., each prestressed membrane or string net is applied with prestress before being placed in the through cavity, and the magnitude of the prestress depends on the acoustic impedance value that the prestressed membrane or prestressed string net is required to reach; and the prestressed membranes or prestressed string nets and the acoustic materials of the filling materials are fixed in the frame by sticking, compacting, clamping or tightening, wherein each prestressed membrane or prestressed string net is designed into different types as required, including seven types, i.e. integrated membrane, hole membrane, string net and other four types, which are described in detail as follows:

(1) integrated membrane: an integrated smooth membrane without holes;

(2) hole membrane: a membrane with holes, and the shape of the hole is roundness, oval, polygon and bounded curve;

(3) string net: filamentous strings are pulled to form a grid pattern, and at every intersection point of the grid, strings are twined together into a knot, or are overlapped each other but are not twined into a knot;

(4) combination of integrated membrane and string net: combining the integrated membrane with the string net;

(5) combination of hole membrane and string net: combining the hole membrane with the string net;

(6) variant type based string net: filamentous strings are pulled to form a grid pattern, and at every intersection point of the grid, strings are connected together by a firm and stiff membrane; and (7) variant type based on stringy re pulled to form a grid pattern, and at every intersection point of the grid, strings are connected together by a polygonal net.

2. The novel ultrathin acoustic impedance converter of claim 1, wherein the frame is a multilayer structure or an integral structure;

the multilayer structure means that the frame is composed of multiple layer structures, one layer structure is fixedly connected with the other layer structure by adhesives, rivets, screws or grooves, to enable the edge of each prestressed membrane or prestressed string net to be sandwiched between adjacent layer structures of the frame, and the prestressed membrane or prestressed string net is positioned and tensioned; and the integral structure means that the frame is an integral whole which cannot be split, wherein there are grooves and holes on the side wall of the cavity for positioning and tensioning all prestressed membranes or prestressed string nets of the filling materials.

3. The novel ultrathin acoustic impedance converter of claim 1, wherein:

for one prestressed membrane or prestressed string net, it can be made from one material or the composition of multiple materials; and for different prestressed membranes or prestressed string nets, their materials or structures can be identical or different;

for one acoustic material layer, it can be made from one material or the composition of multiple materials; and for different acoustic material layers, their materials or structures can be identical or different.

4. A novel ultrathin acoustic impedance converter, comprising at least one impedance conversion unit which comprises a frame and filling materials thereof;

wherein a through cavity is fabricated in the frame for placing the filling materials;

the filling materials comprise prestressed membranes and multilayer acoustic materials, the prestressed membrane and the acoustic material layer are alternately arranged, and some or all of the prestressed membranes can be replaced by prestressed string nets;

the prestressed membranes or the prestressed string nets mean membranes or string nets applied with prestress, i.e., each prestressed membrane or string net is applied with prestress before being placed in the through cavity, and the magnitude of the prestress depends on the acoustic impedance value that the prestressed membrane or prestressed string net is required to reach; and the prestressed membranes or prestressed string nets and the acoustic materials of the filling materials are fixed in the frame by sticking compacting, clamping or tightening, wherein each layer of multilayer acoustic materials of the filling materials is designed into different types of structures as required, including integrated structure, porous structure, solid filling structure, 3D string net structure and other four types of structures which are described in detail as follows:

(1) integrated structure: the acoustic material layer is a whole without holes;

(2) porous structure: the acoustic material layer has holes in it, and the shape of the hole is sphere, cylinder, truncated cone, cone, polyhedron or prism;

(3) solid filling structure: the acoustic material layer has solids in it, and the shape of the solid is sphere, cylinder, truncated cone, cone, polyhedron or prism;

(4) 3D string net structure: filamentous strings are pulled to form a 3D grid pattern, and at every intersection point of the grid, strings are twined together into a knot, or are overlapped each other but are not twined into a knot;

(5) combination of integrated structure and 3D string net structure: combining the integrated structure with the 3D string net structure;

(6) combination of porous structure and 3D string net structure: combining the porous structure with the 3D string net structure;

(7) variant type based on 3D string net structure: filamentous strings are pulled to form a 3D grid pattern, and at every intersection point of the grid, strings are connected together by acoustic material solids, and the shape of the acoustic material solid is sphere, cylinder, truncated cone, cone, polyhedron or prism;

(8) variant type based on 3D string net structure: filamentous strings are pulled to form a 3D grid pattern, and at every intersection point of the grid, strings are connected together by 3D nets or shells and the shape of the 3D net or shell is sphere, cylinder, truncated cone, cone, polyhedron or prism.

* * * * *